US005139221A

United States Patent [19]

Lodrick

[11] Patent Number: 5,139,221

[45] Date of Patent: Aug. 18, 1992

[54] RELEASABLY MOUNTABLE BILLIARD/POOL CUE HOLDER

[76] Inventor: Lester B. Lodrick, 603 E. Meyers, Hazel Park, Mich. 48030

[21] Appl. No.: 808,526

[22] Filed: Dec. 16, 1991

Related U.S. Application Data

[63] Continuation-in-part of Ser. No. 587,081, Sep. 24, 1990, Pat. No. 5,072,908.

[51] Int. Cl.[5] ..... A47F 7/00

[52] U.S. Cl. ..... 248/231.8; 211/68; 211/86; 248/110

[58] Field of Search ..... 248/231.8, 110, 914, 248/316.9, 309.2; 211/68, 86, 70.8, 65, 67, 66, 60.1, 120

[56] References Cited

U.S. PATENT DOCUMENTS

| | | | |
|---|---|---|---|
| 1,105,083 | 7/1914 | Lamb . | |
| 1,174,185 | 3/1916 | Scott . | |
| 1,240,705 | 9/1917 | Grode . | |
| 2,216,886 | 10/1940 | Langelier | 248/311 |
| 2,613,079 | 10/1952 | Reynolds | 273/71 |
| 2,869,812 | 1/1959 | Hamel | 248/42 |
| 4,036,368 | 7/1977 | Munsch | 211/60 |
| 4,103,781 | 8/1978 | Sterling | 211/86 |
| 4,116,342 | 9/1978 | Winfree, Jr. | 211/68 |
| 4,819,903 | 4/1989 | Jimenez | 248/538 |

*Primary Examiner*—David L. Talbott
*Attorney, Agent, or Firm*—Basile and Hanlon

[57] ABSTRACT

A holder for supporting an elongated object, such as a billiard/pool cue, in a generally upright position. The holder in one embodiment includes a body formed of a resilient flexible material molded as a single piece. The holder includes first and second normally co-planar side walls, each formed of a central leg and two spaced end legs. First and second flexible coupler members are joined to and extend between opposite ones of the end legs of the first and second side walls. Outward movement of the first and second coupler members away from each other as the body is urged over a support surface causes the first and second side walls to pivot inward to form a channel between the first and second side walls and the support surface for supporting an elongated object in a generally upright position. In an alternate embodiment, a planar wall member is releasably engageable between the side walls of the holder when the side walls are inwardly pivoted toward each other. One or more divider members are mountable on the wall member to form a plurality of open-ended notches on the holder for supporting a plurality of elongate members.

8 Claims, 6 Drawing Sheets

RELEASABLY MOUNTABLE BILLIARD/POOL CUE HOLDER

CROSS REFERENCE TO CO-PENDING APPLICATION

This application is a continuation-in-part application of co-pending U.S. patent application Ser. No. 07/587,081, filed on Sep. 24, 1990, now U.S. Pat. No. 5,072,908, in the name of Lester B. Lodrick and entitled "Releasably Mountable Billiard/Pool Cue Holder".

BACKGROUND OF THE INVENTION

1. Field of the Invention

The present invention relates, in general, to holders for supporting elongated members in a generally upright position and, specifically, to holders for supporting a billiard/pool cue in a generally upright position when not in use.

2. State of the Art

In the game of billiards or pool, it is common for a player not currently shooting to rest his cue against a convenient support surface, such as the arm of a chair. Due to the tapered, cylindrical shape of the cue, the cue can easily roll along the support surface and fall to the floor resulting in damage or even breakage of the cue tip or the cue itself.

What is needed is an easily repositionable holder which can securely hold a billiard or pool cue in a generally upright position when not in use so as to prevent the cue from falling to the floor. While racks are well knows for supporting a number of billiard/pool cues when the cues are not in use, such racks are typically stationarily mounted in one location, such as on a wall, and away from the location of chairs typically situated around a billiard/pool table. Thus, it is inconvenient for a player to have to place his cue in a central rack each time he temporarily finishes shooting.

Thus, it would be desirable to provide a holder for supporting an elongated object or member in a generally upright position which is easily repositionable and mountable on various support surfaces convenient to a user. It would also be desirable to provide a holder which prevents an elongated object supported in a generally upright position from falling to the floor. It would also be desirable to provide a holder which is specifically designated to support a billiard/pool cue in a generally upright position when the cue is not in use. It would also be desirable to provide a holder for supporting a billiard/pool cue which is easily and releasably mountable on a support surface. Finally, it would be desirable to provide a billiard/pool cue holder which is inexpensive in manufacturing cost and easy to use.

SUMMARY OF THE INVENTION

The present invention is a holder which is releasably mountable on a support surface for supporting an elongated member in a generally upright position.

In a preferred embodiment, the holder includes a body. The body is formed of first and second article support members for supporting an elongated article in a generally upright position. Hinge means are provided for hingedly connecting the first and second article support means for pivotal movement with respect to each other. Clamp means are coupled to the hinge means for releasably clamping the body on a support surface to support an elongated member in a generally upright position with respect to the support surface.

In one embodiment, the holder comprises a body, preferably formed as an integral, one piece member. The body includes first and second, normally, co-planar side walls defining the article support members. Each of the first and second side walls has a central leg and two spaced end legs flexibly and coplanarly joined to opposite ends of the central leg and extending outward from the central leg toward the end legs of the opposite one of the first and second side walls. The hinge means comprises first and second flexible coupler members joined to and extending between one of the end legs of each of the first and second side walls. Outward opposite movement of the first and second coupler members causes inward movement of the first and second side walls toward each other about the first and second coupler members to form a channel between the first and second side walls and a support surface when the holder is mounted on the support surface.

Preferably the body, including the first and second side walls and the first and second coupler members, is integrally formed as a one piece member from a molded, resilient material. This provides the desired degree of flexibility in the body to enable the body to be releasably mounted on a support surface, such as the arm of a chair, and to simultaneously permit the first and second side walls to pivot toward each other about the first and second coupler members to form a channel for supporting an elongated member in a generally upright position.

The first and second end legs of each of the first and second side walls are preferably disposed at an acute angle with respect to the associated central leg. This enables the end legs to move outward from each other as the first and second coupler members are pulled apart such that the first and second coupler members and the end legs of each of the first and second end walls form a clamp means which is disposed in releasable engagement with a support surface, such as the arm of a chair, to releasably mount the holder on the support surface.

In another embodiment, the end legs of the side walls of the holder have a tapered shape extending from a larger cross section end connected to the central leg to a smaller cross section outer end. This provides greater flexibility to the end legs to enable the holder to be more securely mounted on a support surface.

In another embodiment, a planar wall member is releasably attachable to the side walls of the holder when the side walls are inwardly pivoted toward each other. The wall member engages the outer edge of a support surface when the holder is mounted on the support surface to insure that the holder is firmly engaged with the support surface. One or more divider members may be spacedly mounted on the wall member to form a plurality of spaced, open-ended notches in conjunction with the inwardly pivoted side walls of the holder for supporting a plurality of elongate members in a generally upright position in the holder.

In yet another embodiment, a wall member has a plurality of spaced divider members extending outward from one surface thereof. First and second clamp means are connected to the wall member and extend outward from the opposite surface of the wall member for releasably engaging a support surface.

In another embodiment, the first and second article support members each comprise a planar strip having opposed ends. An open-ended notch is formed in at least one and preferably both of the first and second article support members for receiving an elongated member therein. In this embodiment, the clamp means comprises one end of the planar strips which is opposite from the ends of the planar strips containing the notch or notches. Preferably, the notches in both of the first and second planar strips are aligned.

The hinge means comprises at least one post which is fixedly connected to the first article support member intermediate the ends of the first article support member and pivotally coupled to the second article support member. Biasing means are fixedly connected to the first and second article support members for normally biasing the clamp means together and to enable the clamp means to move apart for engagement about a support surface when the opposite ends of the planar strips are urged together.

In yet another embodiment, the hinge means comprises biasing means pivotally mounted at opposite ends and extending between the first and second article support members. A plate is pivotally mounted on one of the first and second article support members intermediate the ends thereof. The plate has an outward extending finger which engages a notch formed in the other article support member to lock the first and second article support members in an angular arrangement wherein the clamp means are engaged and the article support portions or notches of the first and second article support means are spaced apart. The plate may be pivoted from its engaged position between the first and second article support members to a lowered position to enable the first and second support members to be moved to a generally overlapping, compact, parallel configuration for easy storage or transport.

In another embodiment, the holder is in the form of a body, preferably molded of an integral one piece member from a resilient material, such as a rubber. A plurality of article support means are co-axially aligned along one end of the body for receiving individual elongated members. Clamp means are formed on the body for releasably clamping the body to a support surface. Finally, hinge means are provided for hingedly connecting the clamp means to the body to enable the clamp means to pivot so as to enable the releasable engagement of the clamp means with a support surface.

In this embodiment, the article support means preferably comprises a plurality of spaced notches formed along one side of the body. A clamp means comprises first and second spaced legs formed on the body opposite from the notches. The first and second legs are releasably engageable with a support surface to mount the body on the support surface. The hinge means comprises the construction of the spaced legs of the clamp means from a resilient material so as to enable the first and second legs to exhibit pivotal movement with respect to each other. Preferably, the first and second legs are disposed at an acute angle with respect to the body so as to enable their outward movement to a generally perpendicular position with respect to the body for engagement with a support surface.

The holder of the present invention is designed to support an elongated object, such as a billiard/pool cue, in a generally upright position and to prevent the elongated object from falling to the floor. Further, the holder of the present invention may be easily repositioned and mounted on other support surfaces thereby facilitating a wide range of uses. Finally, the present holder is inexpensive in cost.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

The present invention is a holder for supporting an elongated object or member in a generally upright position. The holder is particularly adapted for supporting a billiard/pool cue, hereafter referred to simply as a cue, in a generally upright position against a support surface.

Figure 1:
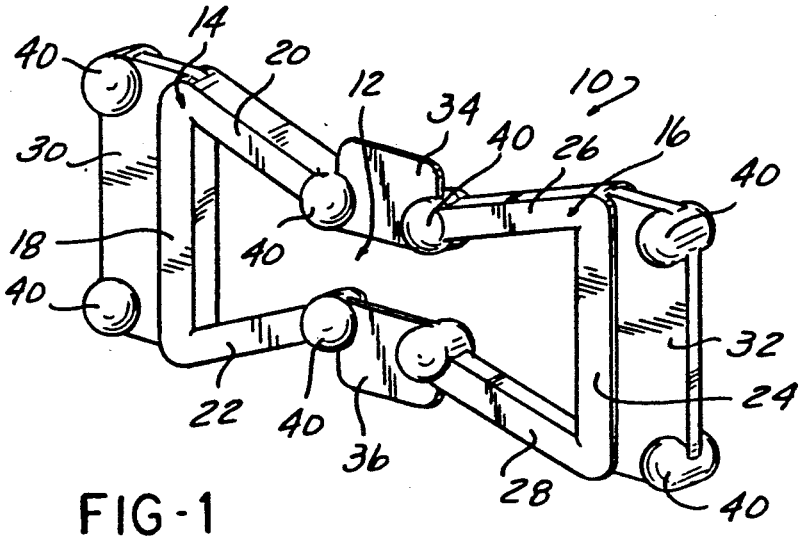
FIG. 1 is a perspective view of one embodiment of the billiard/pool cue holder of the present invention.
Figure 2:
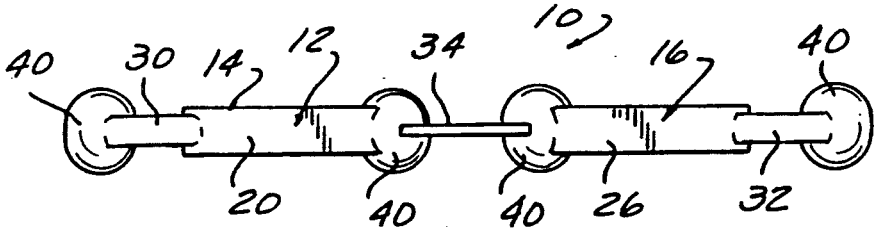
FIG. 2 is a plan view of the holder shown in FIG. 1.

Referring now to FIGS. 1 and 2, the holder 10 in one embodiment includes a body 12. Preferably, the body 12 is formed of a one piece, integrally molded member. However, it will be understood that the teachings of the present invention also encompass the formation of the body 12 from a number of separate pieces which may be joined together to function as a unit.

The body 12 is preferably formed of a flexible, resilient material, such as a rubber. Examples of typical materials which can be used to form the body 12 include silicone rubber and pourable mold rubber as well as other materials exhibiting the desired flexibility and resilient characteristics.

The body 12 includes first and second side walls 14 and 16, respectively. The first and second side walls 14 and 16 are identically constructed and are normally disposed in a co-planar relationship.

Each of the first and second side walls 14 and 16, includes a central leg and two end legs which are joined to opposite ends of the central leg and extend outward therefrom. Thus, the first side wall 14 includes a central leg 18 and first and second end legs 20 and 22, respectively, which are joined to opposite ends of the central leg 18 and extend outward from one side therefrom. Similarly, the second side wall 16 includes a central leg 24 and first and second end legs 26 and 28, respectively, which are joined to and extend outward from one side of opposite ends of the central leg 24.

The first and second legs 20 and 22 of the first side wall 14 and the first and second legs 26 and 28 of the second side wall 16 are preferably disposed at an acute angle with respect to the associated central leg !8 and 24. Due to the flexible, resilient nature of the material employed in forming the body 12, the end legs 20, 22, 26 and 28 are able to flex and move outward into a generally perpendicular relationship with the associated central legs 18 and 24, as described hereafter.

Although the first and second side walls 14 and 16 are illustrated as having a generally square cross section, it will be understood that other configurations, such as circular, rectangular, etc., may also be employed to form each of the first and second side walls 14 and 16.

First and second planar extensions 30 and 32, respectively, are joined to and extend outward from the central legs 18 and 24, respectively, opposite from the associated end legs 20, 22, 26 and 28. The first and second extensions 30 and 32 are integrally joined to and formed with the associated central legs 18 and 24 and provide additional support surfaces for supporting an elongated object, such as a cue 11, in a generally upright position.

The holder 10 also includes first and second coupler members 34 and 36, respectively. Each of the first and second coupler members 34 and 36 are in the form of thin, planar strips and act as a hinge means for the body 12. The first and second coupler members 34 and 36 are also flexible and are preferably integrally joined to and extend between associated end legs of the first and second side walls 14 and 16 to hingedly couple the first and second side walls 14 and 16 together as an integral unit. Thus, the first coupler member 34 is joined to and extends between the outermost ends of the first end legs 20 and 26. Similarly, the second coupler member 36 extends between and is joined to the outer ends of the second end legs 22 and 28. As shown in FIG. 1, the first and second coupler members 34 and 36 are normally spaced apart on the body 12.

Enlarged spherical or ball-shaped areas 40 are formed on the outer ends of the planar extensions 30 and 32 and the outermost ends of the end legs 20, 22, 26 and 28 at the points of joinder between the end legs and the first and second coupler members 34 and 36. The spherical or ball-shaped areas 40 are provided for an aesthetic purpose as well as to provide an increased material buildup at several portions of the body 12.

Figure 3:
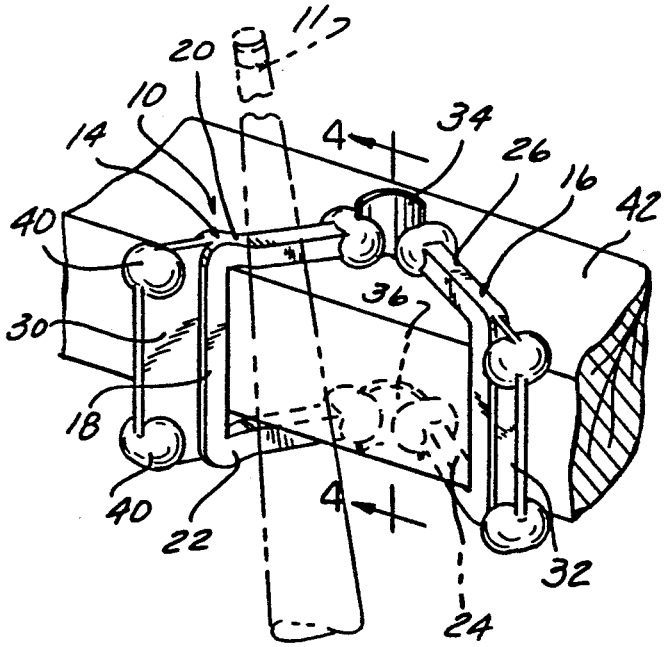
FIG. 3 is a perspective view of the holder shown in a deployed position on a support surface and supporting an elongated billiard/pool cue.
Figure 4:
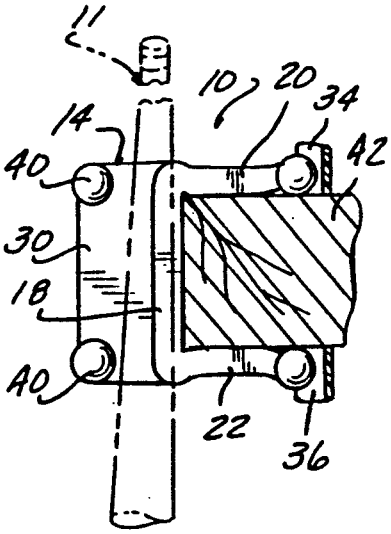
FIG. 4 is a cross sectional view generally taken along line 4—4 in FIG. 3.

In normal operation, when it is desired to support an elongated object, such as a cue 11, in an upright position against a support surface denoted in general by reference number 42 in FIGS. 3 and 4, the holder 10 which is in its normal, co-planar configuration is grasped by the user. The user then urges the first and second coupler members 34 and 36 outward in opposite directions. This outward movement of the first and second coupler members 34 and 36, respectively, causes the end legs 20 and 22, and 26 and 28 to flex and move about their point of connection to the associated central legs 18 and 24. Also during this outward movement, the first and second coupler members 34 and 36 assume a generally curved shaped as shown in FIG. 3. The holder 10 may then be disposed over a suitable support surface 42, such as the arm of a chair, with the first and second coupler members 34 and 36 and the end legs 20, 22, 26 and 28 contacting adjacent surfaces on the support surface 42 and acting as a clamp means to securely mount the holder 10 on the support surface 42.

During the outward movement of the first and second coupler members 34 and 36, the first and second side walls 14 and 16 are urged inward toward each other about the hinge connection between the first and second side walls 14 and 16, respectively, and the coupler members 34 and 36 extending therebetween. This forms a substantially V-shaped channel between the central legs 18 and 24, the associated planar extensions 30 and 32 of the side walls 14 and 16, and a portion of the support surface 42 as shown in FIGS. 3 and 4. This channel is ideally suited for supporting an elongated cue 11 in an upright position where one end of the cue 11 rests on the floor. The channel also prevents the cue 11 from rolling along the support surface 42 whereby it may fall to the floor causing damage to or breakage of the tip of the cue 11 or the cue 11 itself. Further, the cue 11 may be easily removed from the holder 10 and reinserted into the holder 10 as desired by a user.

The holder 10 may be removed from the support surface 42 by pulling the planar extensions 30 and 32 outward from the support surface 42 or by grasping the coupler members 34 and 36 and urging them apart. The holder 10 may then be reapplied to another portion of the support surface 42 or a different support surface as desired.

Figure 5:
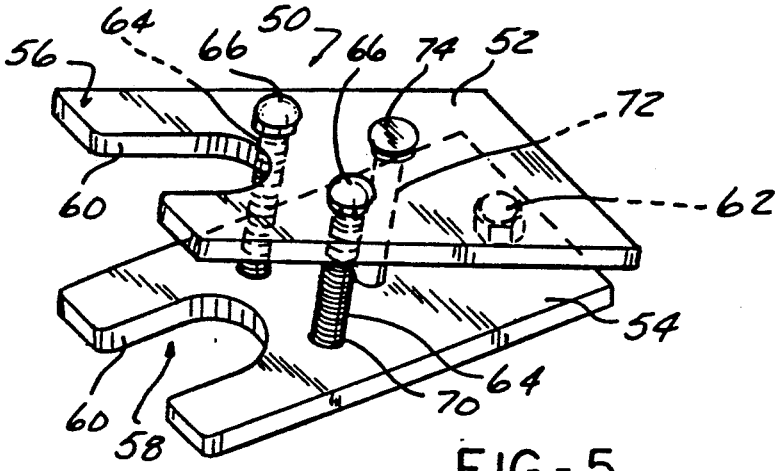
FIG. 5 is a perspective view of another embodiment of the holder of the present invention.
Figure 6:
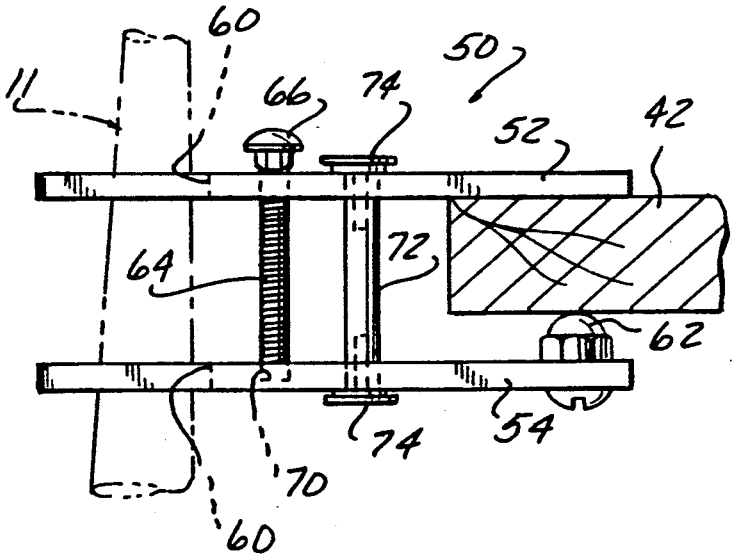
FIG. 6 is a side elevational view of the holder illustrated in FIG. 5 shown mounted on a support surface.

Referring now to FIGS. 5 and 6, there is illustrated another embodiment of a holder 50 of the present invention. In this embodiment, the holder 50 is formed of first and second generally planar strips 52 and 54, respectively. The first and second planar strips 52 and 54 are preferably formed of a plastic material; although other materials may also be employed.

First and second article support members 56 and 58, respectively, are formed on one end of the first and second planar strips 52 and 54, respectively. The first and second article support members 56 and 58 are generally in the form of open-ended notches 60 having a substantially U-shape with the open end extending outward from one end of the planar strips 52 and 54. A notch 60 is formed in at least one and preferably both of the planar strips 52 and 54. Further, when notches 60 are employed in both of the planar strips 52 and 54, the notches are aligned, as shown in FIGS. 5 and 6. Protective pads or cushions, not shown, may be attached to the inner edges of the notches 60 to protect a member or object 11 disposed therein, as described hereafter.

Figure 8:
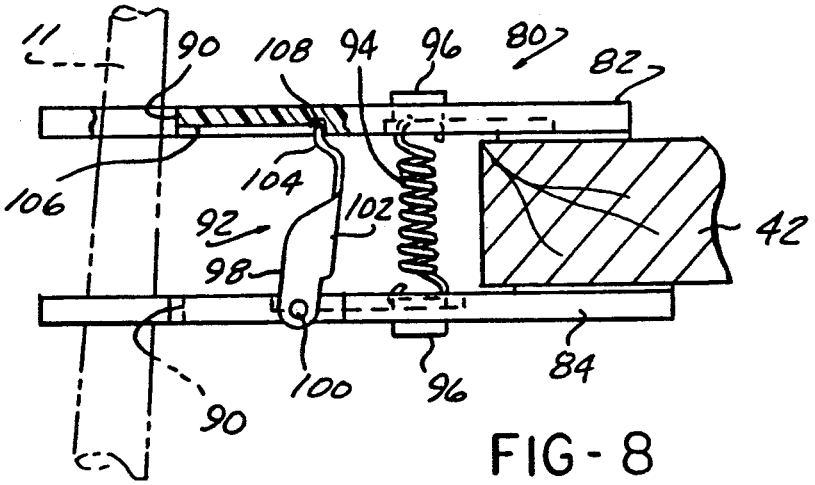
FIG. 8 is a side elevational view of the holder illustrated in FIG. 7 shown mounted on a support surface.

A stop 62 is fixedly mounted on the second planar strip 54 for engagement with a support surface 42. Alternately, protective cushions, as shown in FIG. 8 and described hereafter, may be employed in place of the stop 62.

Hinge means are provided for pivotally interconnecting the planar strips 52 and 54 for relative pivotal movement with respect to each other. The hinge means comprises at least one and preferably two aligned posts 64. The posts 64 are disposed intermediate the ends of the planar strips 52 and 54 and have one end fixedly connected to one of the planar strips, such as planar strip 52 as shown in FIGS. 5 and 6. By way of example only, the posts 64 are shown as threaded screws having a cap or head 66 extending externally from the first planar strip 52. One end of each of the posts 64 is fixedly mounted in the first strip 52. The opposite end of each post 64 pivotally rides within a recess 70 formed in the second planar strip 54.

Biasing means generally denoted by reference number 72 is fixedly connected to and extends between the planar strips 52 and 54. The biasing means is illustrated as being in the form of a cylindrical resilient member, such as a member formed of rubber. It will be understood that coil springs and other biasing means may also be employed. Suitable fasteners 74 are provided for fixedly mounting the ends of the biasing means 72 to the planar strips 52 and 54.

The posts 64 and the biasing means 72 cooperate as a hinge means to enable the planar strips 52 and 54 to be pivoted from the normal unclamped position shown in FIG. 5 to a clamped position shown in FIG. 6 in which the clamp means at one end of the planar strips 52 and 54 is disposed about a support surface 42 to securely mount the holder 50 to the support surface 42. In this position, the article support members 56 and 58 may receive an elongated member 11, such as a pool cue, to support the member 11 in a generally upright position adjacent the support surface 42.

Figure 7:
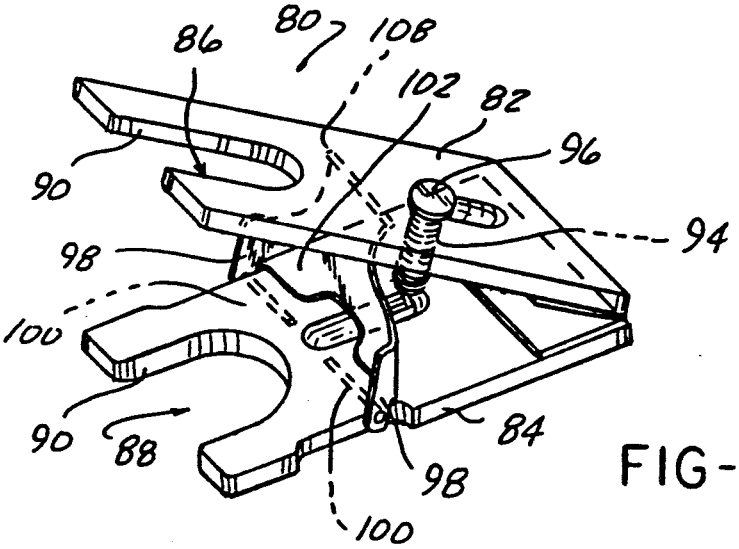
FIG. 7 is a perspective view of yet another embodiment of the holder of the present invention.
Figure 9:
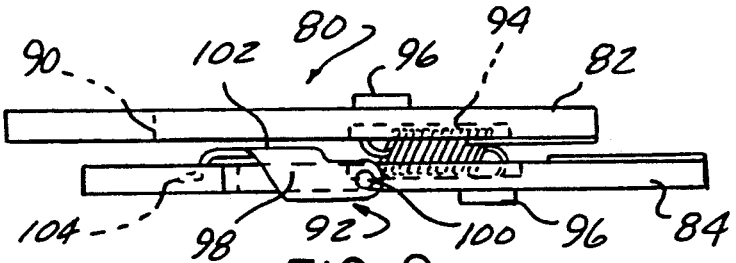
FIG. 9 is a side elevational view of the holder illustrated in FIGS. 7 and 8 shown in its compact, collapsed position.

Another embodiment of the present invention is shown in FIG. 7, 8 and 9. In this embodiment, a holder 80 is generally similar to the holder 50 shown in FIGS. 5 and 6 in that it includes first and second generally planar strips 82 and 84, respectively. Article supporting means 86 and 88 are formed at one end of one and preferably both of the planar strips 82 and 84. The article supporting means, by way of example only, may comprise a generally U-shaped, open-ended notch 90 formed in one end of one or both of the planar strips 82 and 84.

The hinge means in the holder 80 comprises a pivotal plate 92 and a biasing means 94, such as a coil spring. The biasing means 94 is pivotally connected at opposite ends to the planar strips 82 and 84 by means of a pivotal connection with a suitable connector 96 mounted in each of the planar strips 82 and 84 intermediate the ends of the planar strips 82 and 84. The plate 92 includes a pair of spaced flanges 98 which are pivotally connected by means of pivot pins 100 to opposite sides of the second planar strip 84. The plate 92 includes a central portion 102 integrally extending between the flanges 98. The central portion 102 terminates in an outwardly extending finger 104.

The finger 104 on the plate 92 releasably engages a notch 106 formed on the inner surface of the planar strip 82 as shown in FIG. 8. The notch 106 tapers from the notch 90 toward the opposite end of the planar strip 82 and terminates in a shoulder 108 which acts as a stop for the finger 104. Pivotal extension of the plate 92 to the upright position shown in FIGS. 7 and 8 spaces one end of the planar strips 82 and 84 apart. In this position, one end of the planar strips 82 and 84 may be pivoted together such that the clamp ends are urged apart to snugly engage and mount the holder 80 on a support surface 42 as shown in FIG. 8.

Further, the plate 92 may be disengaged from the notch 106 and pivoted to a generally downward, lowered position shown in FIG. 9 substantially contiguous with the second planar strip 84. The opposite or first planar strip 82 may then be urged rearward with respect to the second planar strip 84 to a generally overlapping, parallel position as shown in FIG. 9. During this pivotal movement, the biasing member 92 pivots about its connection to the connectors 96 to provide a compact storage position for the holder 80.

Figure 10:
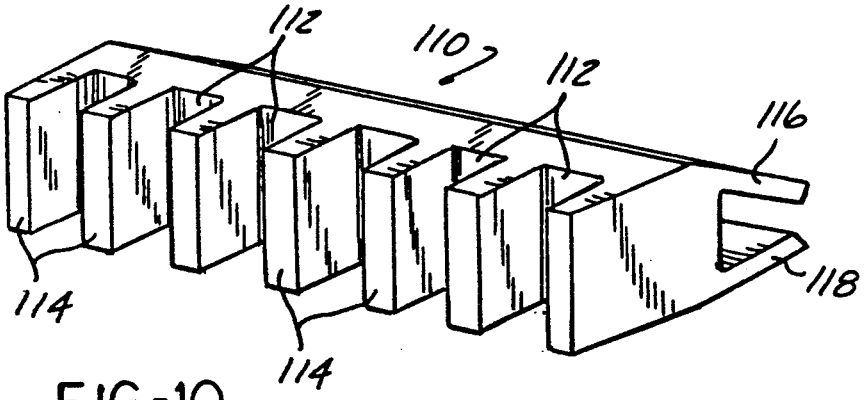
FIG. 10 is a perspective view of yet another embodiment of the article holder of the present invention.
Figure 11:
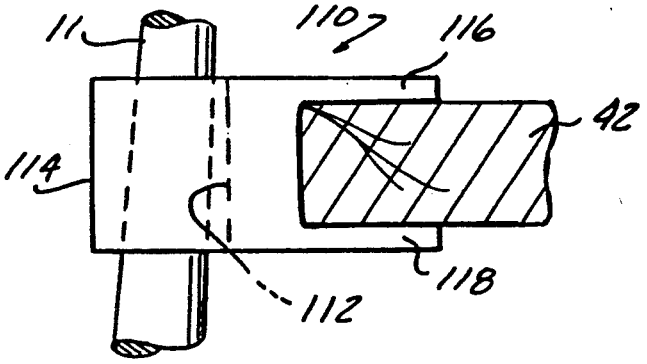
FIG. 11 is a side elevational view of the holder illustrated in FIG. 10 shown mounted on a support surface.

FIGS. 10 and 11 depict another embodiment of the present invention in which a holder 110 is integrally formed as a single piece member of a resilient, moldable material in the same manner as the embodiment shown in FIG. 1 and described above. The holder 110 includes article support means in the form of a plurality of notches 112 spaced along one end surface of the body of the holder 110. A plurality of outwardly extending flanges 114 are integrally formed with the body of the holder 110 and are spaced apart to define the notches 112. The notches 112 are adapted for receiving and supporting an elongated member 11, such as a billiard-/pool cue as shown in FIG. 11, when the holder 110 is mounted on a support surface 42.

The holder 110 also includes clamp means in the form of a pair of first and second spaced legs 116 and 118. The legs 116 and 118 are integrally formed with the body of the holder 110 and extend outward from the body of the holder 110 opposite from the flanges 114. Since the body of the holder 110 is formed of a resilient material, the legs 116 and 118 of the clamp means may pivot with respect to the remainder of the body for releasable engagement to a support surface 42.

The holder 110 includes biasing or hinge means which comprises the resilient material forming the body of the holder 110. The resilient material enables the clamp legs 116 and 118 to pivot outward from their normal positions shown in FIG. 10 to engage a support surface 42.

In a preferred embodiment, the spaced legs 116 and 118 extend angularly inward toward each other at an acute angle with respect to the body of the holder 110. This enables the legs 116 and 118 to move outward when brought into engagement with a support surface 42 to releasably and securely attach the holder 110 to the support surface 42 for supporting an elongated member 11 in a generally upright position.

Alternately, the clamp means may comprise pairs of spaced legs similar to legs 116 and 118 disposed at opposite ends of the body of the holder 110. Each of the pairs of spaced legs operates in the same manner and is generally formed in the same configuration as the continuous legs 116 and 118 shown in FIG. 10.

Figure 12:
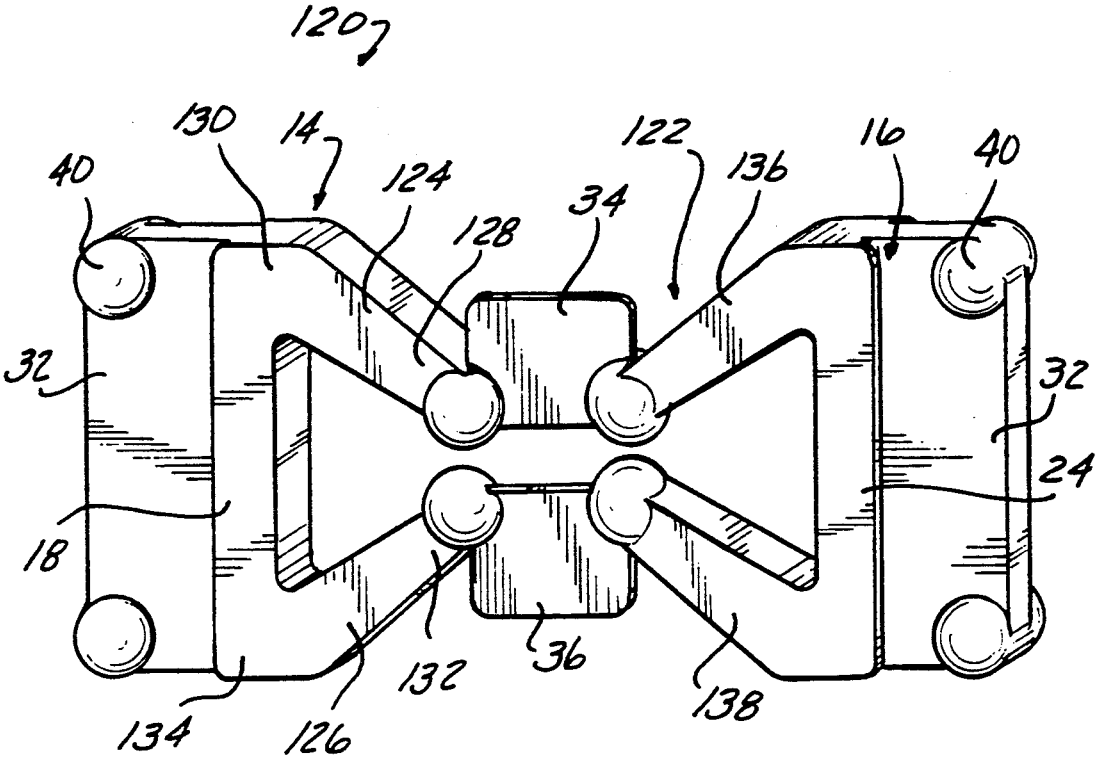
FIG. 12 is a perspective view of another embodiment of the billiard/pool cue holder shown in FIG. 1.

FIG. 12 depicts another embodiment of the holder of the present invention. The holder 120 shown in FIG. 12 is substantially identical to the holder 10 shown in FIG. 1 and described above. Elements of the holder 120 which are identical in construction and function with the corresponding elements in the holder 10 are labelled with like reference numbers. The improvement in the holder 120 lies in the shape of the end legs connected to the central leg in each of the side walls of the body 122 of the holder 120.

The side wall 14 of the body 122 has a central leg 18 and two spaced, end legs 124 and 126. The end leg 124 has a first end 128 connected to the first coupler member 34 and an opposed, second end 130 connected to one end of the central leg 18. Similarly, the identically constructed second end leg 126 has a first end 132 connected to the second coupler member 36 and an opposed second end 134 connected to the opposite end of the central leg 18. The opposed side wall 16 has a central leg 24 connected to two opposed end legs 136 and 138 which are identical to the end legs 124 and 126.

As shown in FIG. 12, each of the end legs 124, 126, 136 and 138 has a tapering construction such that the height of each of the end legs 124, 126, 136 and 138 at the second end, such as the second ends 130 and 134 for the end legs 124 and 126, respectively, is greater than the height of each of the end legs at the opposed, first ends. Specifically, the height of the second end 130 of the first end leg 124 is greater than the height of the first end leg 124 at its first end 128. The remaining end legs 126, 136 and 138 are identically constructed with the same tapering height or cross section. Conversely, the width of each end leg could vary from end to end. This arrangement provides greater flexibility for each of the end legs 124, 126, 136 and 138 which enables the end legs to flex a greater amount to more securely attach the holder 120 to a support surface.

Figure 13:
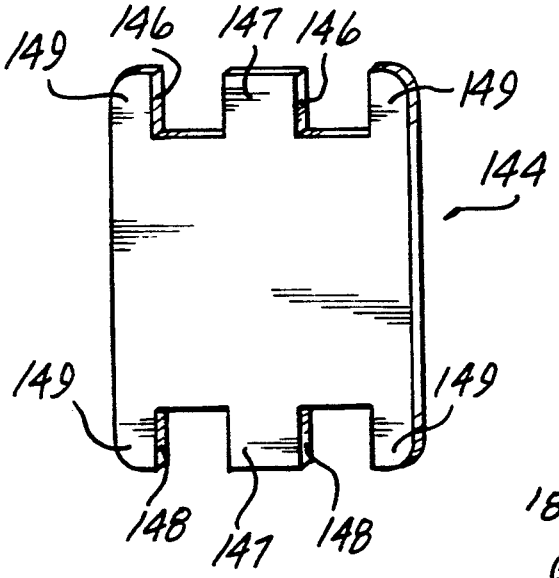
FIG. 13 is a perspective view of a wall member employable with the holders shown in FIGS. 1 and 12.
Figure 14:
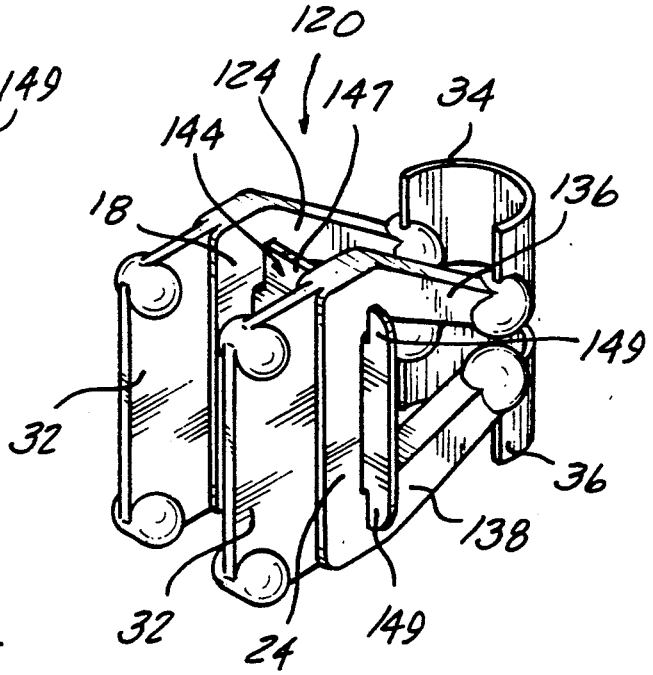
FIG. 14 is a perspective view of the holder shown in FIG. 12 in a deployed position with the wall member shown in FIG. 13 mounted therein.
Figure 15:
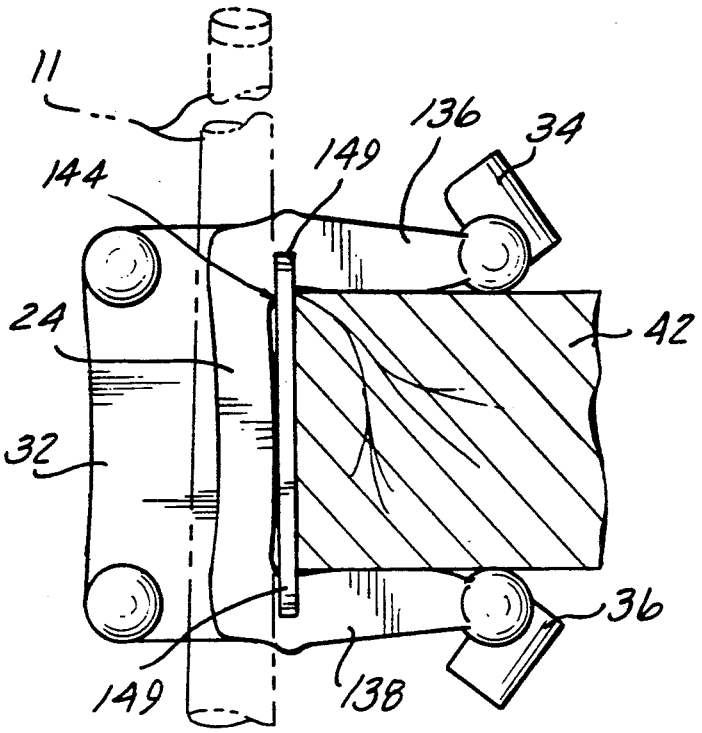
FIG. 15 a partially sectioned, side elevational view of the holder shown in FIG. 14 mounted on a support surface.

FIGS. 13-15 depict a wall member 144 which is employable with the holder 10 or the holder 120 described above. The function of the wall member 144, when attached to the body of the holder 120, for example, is to insure that the holder 120 is fully engaged onto a support surface. This is achieved by forcibly urging the holder 120 onto the support surface, as described above, until the wall member 144 firmly engages the edge of the support surface.

As shown in FIG. 13, in one embodiment, the wall member 144 has a generally planar shape and is formed of a resilient material, such as rubber. A pair of spaced notches 146 extend inward from one edge of the wall member 144. A second pair of spaced notches 148 extend inward from the opposite edge of the wall member 144. The aligned pairs of notches 146 and 148 thus form elongated side legs having a pair of oppositely outwardly extending flanges 149 which extend from the solid central portion of the wall member 144. An enlarged, solid, central portion 147 is also formed between each pair of notches 146 and 148 as shown in FIG. 13.

In use, the wall member 144 is releasably engaged with the body 122 of the holder 120, or the body 12 of the holder 10, by urging the pairs of notches 146 and 148 into engagement with the inner surfaces of the end legs 124, 126, 136 and 138 of the holder 122, for example. The end flanges 149 of the wall member 144 are thus disposed outward from the sides of the central legs 18 and 24, as shown in FIG. 14. The enlarge central area 147 of the wall member is disposed between the side walls 14 and 16 of the body 122 of the holder 120. It should be noted that the side walls 14 and 16 will be urged together, as shown in FIG. 14, during the attachment of the wall member 144 to the body 122 of the holder 120. It will also be understood that at least one or both ends of the wall member 144 may be permanently attached to the body 122 of the holder 120. However, this fixed connection detracts from the flat shipping arrangement provided when the wall member 144 is separate from the holder 120 and is releasably attachable thereto when needed.

After the wall member 144 has been attached to the body 122 of the holder 120, the holder 120 may be employed in normal operation as described above. The coupler members 34 and 36 may be pulled apart to forcibly urge the end legs 124, 126, 136 and 138 of the body 122 outward over the surfaces of a support surface 42, such as the edge of a table, chair, etc., as shown in FIG. 15. The coupler members 34 and 36 are urged over the support surface 42 until the wall member 144 firmly engages the outer edge of the support surface 42. This insures that the holder 120 is firmly mounted on the support surface.

Figure 16:
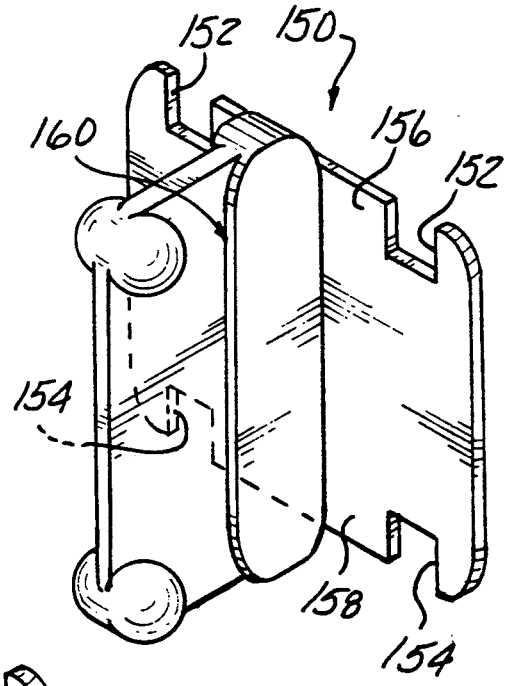
FIG. 16 is another embodiment of the wall member shown in FIG. 13.
Figure 17:
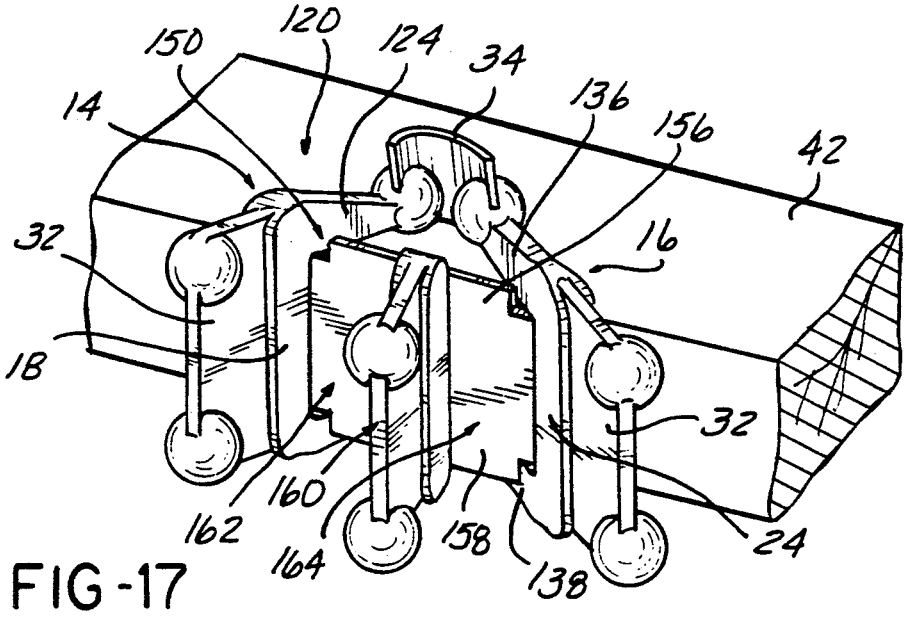
FIG. 17 is a perspective view showing the wall member of FIG. 16 mounted on the holder of FIG. 12 and deployed in an article supporting position on a surface.

FIGS. 16 and 17 depict an alternate embodiment of the wall member which may be employed with any of the holders 10 or 120 described above. The wall member 150 is substantially identical to the wall member 144 described above and is formed of a resilient material. A first pair of notches 152 are formed in one edge of the wall member 150 and a second pair of notches 154 are formed in an opposite edge of the wall member 150. The pairs of notches 152 and 154 form enlarged end legs, as described above, and an enlarged central area formed by two outwardly extending flanges 156 and 158 which extend outward from a solid central portion of the wall member 150.

At least one divider 160 is integrally mounted to the wall member 150, substantially centrally between the sides thereof. The divider member 160, thus, is mounted on the enlarged central portion of the wall member 150 and extends across the flanges 156 and 158, as shown in FIGS. 16 and 17.

The divider member 160 may have any desired shape. For ease of manufacture, the divider member 160 is illustrated, by example only, as having a shape similar to the central leg and planar extension of one of the side walls of the holder 120. The divider member 160 may have other shapes, such as a flat, planar shape, arcuate shape, etc.

FIG. 17 depicts the wall member 150 mounted on the holder 120 in the same manner as described above for the wall member 144 and the holder 120. When the holder 120 is mounted on a support surface 42, the wall member 150 will be in firm engagement with an edge of the support surface 42. The divider member 160 is spaced between the central legs 18 and 24 of the side walls 14 and 16, respectively, of the holder 120 to form a pair of spaced notches 162 and 164 in conjunction with the side walls 14 and 16 and the wall member 150 which receive and support elongated members, such as billiard/pool cues. It will be understood that the wall member 150 may be expanded in width so as to enable multiple divider members to be spacedly mounted thereon to provide support for additional elongated members.

Figure 18:
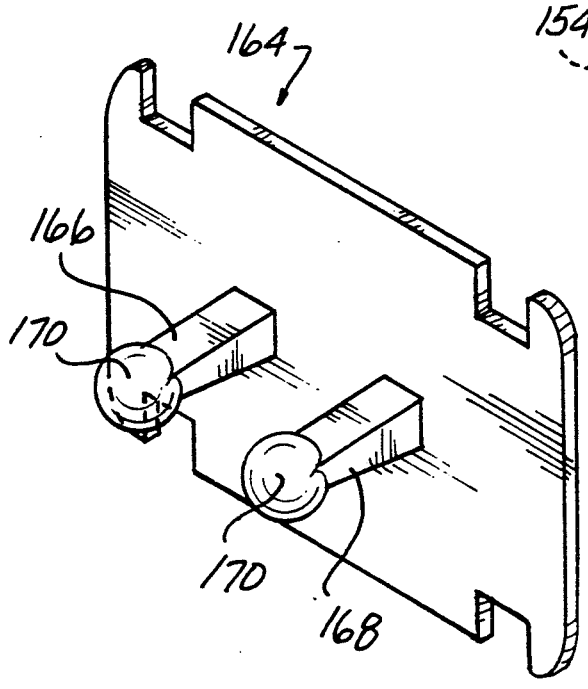
FIG. 18 is a perspective view of another embodiment of the wall member.

FIG. 18 depicts another embodiment of the wall member in which the wall member 164 is substantially identical to the wall members 144 and 150 described above except that it has a slightly wider dimension. In this embodiment, a plurality of dividers, such as two dividers 166 and 168, are fixedly attached to or integrally formed with the wall member 164. The dividers 166 and 168 have, for example only, a generally tubular shape of any cross section, such as circular, square, tapered, etc. The enlarged spherical or ball shaped areas 170 at the outer ends of each of the dividers 166 and 168 are depicted by way of example only as providing a secure retention surface for retaining elongated articles or members in the holder 120 to which the wall member 164 is mounted.

The divider members 166 and 168, which may be provided in any number, are spaced apart to form an article receiving notch or recess therebetween. When the wall member 164 is mounted to one of the holders, such as holder 120, the dividers 166 and 168 will be spaced between the side walls 14 and 16, of the holder 120 thereby forming a plurality of recesses or notches in conjunction with the side walls 14 and 16 as well as between the dividers 166 and 168 themselves, for receiving a plurality of elongated members in each individual recess or notch. It should be noted that the wall member 164 is releasably attached to one of the holders 110 or 120 in the same manner as described above for the wall members 144 and 150.

Figure 19:
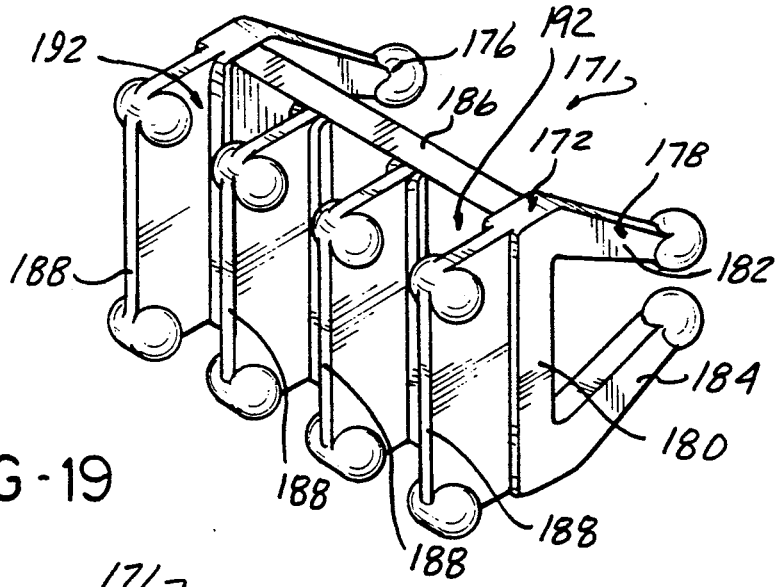
FIG. 19 is a perspective view of another embodiment of the holder of the present invention.
Figure 20:
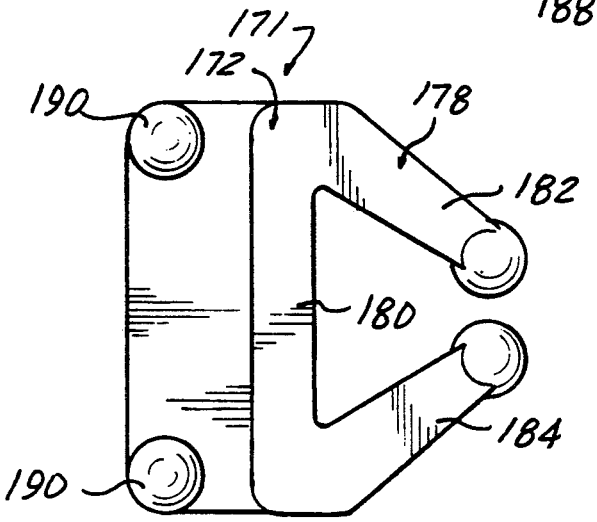
FIG. 20 is a side elevational view of the holder shown in FIG. 19.

Finally, another embodiment of the holder of the present invention is shown in FIGS. 19 and 20. In this embodiment, a holder 171 is in the form of a body 172 which may be formed of interconnected components or integrally molded as a unitary one-piece member. The body 172 includes a pair of clamp means 176 and 178 which are spaced on opposite ends of the body 172. The clamp means 176 and 178 are identically constructed and have somewhat the same shape as the central leg and opposed end legs of each of the side walls 14 and 16 of the holders 10 and 120 described above. Thus, by way of example only, the clamp means 178 includes a central leg 180 and a pair of opposed, angularly extending end legs 182 and 184 which project angularly inward from opposite ends of the central leg 180 toward each other. The outer ends of the end legs 182 and 184 are spaced apart. Preferably the height of each of the end legs 182 and 184 at the end connected to the central leg 180 is greater than the height of the opposite end of each of the end legs 182 and 184 to provide greater resiliency to the end legs 182 and 184 to enable the end legs 182 and 184 to be urged apart over and into secure engagement with a support surface, as described above.

A wall member 186 extends across and is joined to the central legs 180 of each of the clamp means 176 and 178. The wall member 186 has a generally planar configuration and is adapted to engage the outer edge of a support surface when the holder 174 is urged over the edge of the support surface in the same manner as the wall members 144 and 150 described above.

A plurality of dividers 188, each substantially identically formed and extend outward from the wall member 186 and the central legs 180 of the clamp means 176 and 178 as shown in FIGS. 19 and 20. The dividers 188 may have any shape and may be integrally formed with the wall member 186 or attached thereto by suitable means, such as by an adhesive. However, by way of example only, the dividers 188 have a shape similar to the shape of the planar extensions 30 o the holders 10 and 120 described above. The enlarged spherical or ball shaped areas 190 at the outer corners of the dividers 188 are to facilitate handling of the holder 174 as well as to provide a more secure engagement with an elongated member disposed between the dividers 188.

The dividers 188 form a plurality of spaced recesses 192 between adjacent pairs of dividers 188, each of which is adapted to receive and support an elongated member in a generally upright position when the holder 174 is mounted on the edge of a support surface as described above.

In summary, there has been disclosed a unique holder for supporting an elongated object, such as a billiard-/pool cue, in a generally upright position with respect to a support surface. The holder of the present invention may be easily applied to any suitable support surface and may be repositioned as needed. Finally, the holder is inexpensively constructed.

What is claimed is:

1. A holder releasably mountable on a support surface for supporting an elongate member, the holder comprising:

a normally planar body, the body including:

first and second article support members; and a two part hinge means for hingedly connecting the first and second article support members for pivotal movement with respect to each other;

the hinge means and the adjoining portions of the first and second article support members reversibly forming a clamp for releasably clamping the body onto a support surface when opposite outward movement of the two parts of the hinge means causes reversible inward pivotal movement of the first and second article support members toward each other, the first and second article support members, when in the inwardly pivoted position, supporting an elongated member in a generally upright position with respect to the support surface; and a planar wall member connectible to the body between the first and second article support members when the first and second article support members are inwardly pivoted toward each other.

2. The holder of claim 1 wherein:

each of the first and second article support members includes first and second normally co-planar side walls, each of the first and second side walls having a central leg and two spaced end legs flexibly and co-planarly joined to opposite ends of the central leg and extending outward from the central leg toward the end legs of the opposed first and second side walls; and first and second opposed pairs of notches formed in opposite sides of the wall member for engaging the end legs of the first and second side walls of the body to mount the wall member to the body in registry with the central legs of the first and second side walls of the body.

3. The holder of claim 1 further comprising:

a divider member mounted on and extending outward from one surface of the wall member;

the divider member cooperating with the first and second side walls of the body when the first and second side walls are inwardly pivoted toward each other to form a plurality of open ended notches between the side walls, the divider member and the wall member for receiving elongated members therein.

4. The holder of claim 3 further comprising:

a plurality of divider members, spacedly mounted on the wall member.

5. The holder of claim 1 wherein the first and second side walls are formed as a one-piece member from a resilient material.

6. The holder of claim 5 wherein the resilient material is a rubber.

7. The holder of claim 1 wherein the first and second end legs of each of the first and second end legs of each of the first and second side walls are normally disposed at an acute angle with respect to the associated central leg of each of the first and second side walls.

8. The holder of claim 1 wherein:

the first and second end legs of each of the first and second side walls are integrally formed with the associated central leg of each of the first and second side walls.

* * * * *